US007569155B2

(12) United States Patent
Schaefer

(10) Patent No.: US 7,569,155 B2
(45) Date of Patent: Aug. 4, 2009

(54) AQUEOUS FOAMING COMPOSITION

(75) Inventor: Ted H. Schaefer, Orchard Hills (AT)

(73) Assignee: Solberg Scandinavian A/S, Saebovagen (NO)

( * ) Notice: Subject to any disclaimer, the term of this patent is extended or adjusted under 35 U.S.C. 154(b) by 200 days.

(21) Appl. No.: 10/496,911

(22) PCT Filed: Dec. 6, 2002

(86) PCT No.: PCT/US02/38937

§ 371 (c)(1),
(2), (4) Date: Jan. 27, 2005

(87) PCT Pub. No.: WO03/049813

PCT Pub. Date: Jun. 19, 2003

(65) Prior Publication Data

US 2005/0118106 A1 Jun. 2, 2005

(30) Foreign Application Priority Data

Dec. 7, 2001 (AU) ..... PR 9374

(51) Int. Cl.
*A62D 1/00* (2006.01)

(52) U.S. Cl. ..... 252/2; 252/3; 252/8.05

(58) Field of Classification Search ..... 252/3
See application file for complete search history.

(56) References Cited

U.S. PATENT DOCUMENTS

| | | | | |
|---|---|---|---|---|
| 1,874,209 | A * | 8/1932 | Schnabel | 261/83 |
| 1,971,997 | A * | 8/1934 | Treichel | 252/3 |
| 2,232,053 | A * | 2/1941 | Daimler et al. | 252/8.05 |
| 2,514,310 | A | 7/1950 | Busse et al. | |
| 3,772,915 | A | 11/1973 | Stamler | |
| 4,060,489 | A | 11/1977 | Chiesa, Jr. | |
| 4,149,599 | A | 4/1979 | Chiesa, Jr. | |
| 4,472,286 | A | 9/1984 | Falk | |
| 4,588,510 | A * | 5/1986 | Salyer et al. | 252/5 |
| 4,717,744 | A | 1/1988 | Boutevin et al. | |
| 4,978,460 | A | 12/1990 | Von Blücher et al. | |
| 4,983,769 | A | 1/1991 | Bertocchio et al. | |
| 5,086,786 | A | 2/1992 | Sogawa et al. | |
| 5,094,853 | A * | 3/1992 | Hagarty | 424/405 |
| 5,215,786 | A | 6/1993 | Kittle | |
| 5,824,238 | A | 10/1998 | Garcia et al. | |
| 5,882,541 | A * | 3/1999 | Achtmann | 252/8.05 |
| 6,262,128 | B1 * | 7/2001 | Stern et al. | 516/10 |
| 2001/0001478 | A1 * | 5/2001 | Dams et al. | 252/2 |

FOREIGN PATENT DOCUMENTS

| | | |
|---|---|---|
| DE | 29 37 333 | 4/1981 |
| DE | 2937333 A1 | 4/1981 |
| EP | 0 659 449 | 6/1995 |
| GB | 2 179 043 | 2/1987 |
| JP | 53-23196 | 3/1978 |
| JP | 60215091 | 10/1985 |
| JP | 2286325 | 11/1990 |
| JP | 04093686 | 3/1992 |
| JP | 2001072930 | 3/2001 |

* cited by examiner

*Primary Examiner*—Mark Eashoo
*Assistant Examiner*—Peter F Godenschwager
(74) *Attorney, Agent, or Firm*—Clifford W. Browning; Krieg DeVault LLP

(57) ABSTRACT

The invention provides an aqueous foaming composition, an expanded foam composition and a process of forming a foam composition concentrate. The aqueous foaming composition comprises a carbonised saccharide mixture, a surfactant, water and optionally further agents including thickeners, solvents, stabilisers, buffers, corrosion inhibitors and preservatives. Foaming compositions of the present invention are particularly suitable for use in fire prevention, suppression and extinguishment, vapour suppression and wetting of surfaces.

21 Claims, No Drawings

AQUEOUS FOAMING COMPOSITION

FIELD OF THE INVENTION

The present invention relates to an aqueous foaming composition, an expanded foam composition and a process of forming a foam composition concentrate. In particular the present invention relates to aqueous foaming compositions containing carbonised or caramelised saccharides. Foaming compositions of the present invention are most preferably substantially or totally bio-degradable and/or environmentally compatible.

BACKGROUND

Foam materials are a class of commercially and industrially important chemical-based materials. Foams can be prepared by aerating a foaming composition (i.e., entrapping air in a foaming composition), which can be derived by diluting a concentrated precursor. Many foams require certain physical properties to be appropriately useful in desired applications. Among preferred physical properties for foams is the property of stability, to allow the foam to be in a useful form over an extended period of time and therefore useful where an especially stable foam can be desirable, e.g., fire prevention, fire extinguishment, vapor suppression and freeze protection for crops. Further uses include the reduction of surface tension for desirable penetration of fuels and wetting of surfaces, eg. fire extinguishment, surface cleaning/decontamination and surface preparation (such as for concrete surfaces).

An important class of commercial foams includes aqueous film-forming foams (e.g., AFFFs and FFFPs), which aqueous compositions typically contain fluorochemical surfactants, non-fluorinated (e.g., hydrocarbon) surfactants, and aqueous or non-aqueous solvents. These foams can be prepared from concentrates by diluting with water (fresh, brackish or sea water) to form a "premix," and then aerating the premix to form a foam.

The foam forming composition is conveniently manufactured as a concentrate, to save space and reduce transportation and storage costs. The dilution prior to use of the concentrate is typically 3% concentration by volume (that is, 3 volumes of foam concentrate per 97 volumes of water). Other typical concentrations include 6% concentration by volume and 1% or less concentration by volume.

The foam can be dispersed onto a liquid chemical fire to form a thick foam blanket that knocks down the fire and then extinguishes the fire by suffocation. These foams also find utility as vapor suppressing foams that can be applied to non-burning but volatile liquids, e.g., volatile liquid or solid chemicals and chemical spills, to prevent evolution of toxic, noxious, flammable, or otherwise dangerous vapors. These foams can also be used on structural and bush or forest fires.

Individual components of a foaming composition contribute toward different physical and chemical properties of the premix and the foam. Selective surfactants can provide low surface tension, high foamability, and good film-forming properties, i.e., the ability of drainage from the foam to spread out and form a film over the surface of another liquid. Organic solvents can be included to promote solubility of surfactants, to promote shelf life of the concentrate, and to stabilize the aqueous foam. Thickening agents can be used to increase viscosity and stability of the foam. Other agents and additives can be used as is known to those skilled in the art.

Especially preferred properties of foams are stability, vapor suppression, and burnback resistance. Stability refers to the ability of a foam to maintain over time its physical state as a useful foam. Some fire-fighting foams, e.g., foams prepared from foaming premix compositions containing surfactant and hydrated thickener, are stable for periods of hours, or at least up to an hour, and are often regularly reapplied. Longer periods of stability can be achieved by adding ingredients such as reactive prepolymers and crosslinkers, polyvalent ionic complexing agents and proteins.

The use of fluorochemical compounds in foaming compositions for fire fighting is wide spread for example as taught in U.S. Pat. Nos. 3,772,195; 4,472,286; 4,717,744; 4,983,769; 5,086,786 and 5,824,238. The fluorinated compounds are generally used as surfactants to reduce the surface tension of the foaming composition. However, the production and use of certain fluorochemicals is being reduced and/or phased-out due to concerns associated with such chemicals and/or their use.

Natural compounds such as protein and polysaccharide additives to fire fighting foam solutions are also known. In particular, polysaccharides have been utilised in many forms including cellulose and its derivatives, guar gum, xanthan gum, and polysaccharide derivatives including molasses and other extractions including formoses, in addition to disaccharides and monosaccharides. The use of these materials in fire fighting foams are disclosed for example in patents U.S. Pat. No. 2,514,310 (1946), JP 53023196 (1978), DE 2937333-A (1981), GB 2179043-A (1986), U.S. Pat. No. 4,978,460 (1988) and U.S. Pat. No. 5,215,786 (1993).

U.S. Pat. No. 2,514,310 describes a composition suitable for production of fire extinguishing foams containing an aqueous solution of an N-acyl, N-alkyl taurine sodium salt and a carboxymethylcellulose sodium salt. The compositions of the invention produce fire extinguishing foams highly effective for extinguishing liquid fires.

JP 53023196 describes the use of carboxymethylated yeast-based protein fire extinguishing solutions. The solutions are especially useful for treating large scale fires; the foams having good heat and oil resisting properties.

DE 2937333-A describes a water composition for extinguishing fires which contains a fire-retardant additive and optionally a wetting or foaming agent, preservative, phosphates, nitrogen compounds and further additives. The fire-retardant additive for use in the invention is a polysaccharide or compounds of this type which include molasses and/or formoses (being formaldehyde polymers).

GB 2179043-A describes aqueous foams primarily for use in the food industry as meringues and cake mixes. The foams are formed when compositions containing one acidic foamable protein, preferably whey protein isolate or bovine serum albumin, and a cationic polysaccharide, preferably chitisan. The aqueous foam composition can additionally contain a soluble sugar such as sucrose.

U.S. Pat. No. 4,978,460 is directed to additives for water for the use in fire fighting compositions containing strongly swelling water-insoluble high molecular weight polymers as a gelatinising agent. The improvement to which the specification is directed relates to the use of release agents to encase and disburse the gelatinising agents protecting them from becoming sticky upon the penetration of water and dust from agglutinating. The preferred release agents of the invention are polyalkylene glycols. Further compounds including diammonium phosphates and sugars such as sugar alcohols including mannitol are described as being suitable for use as the release agent.

U.S. Pat. No. 5,215,786 describes compositions for forming a biodegradable foam barrier between a substrate and the atmosphere. The foam-forming composition includes sodium sulphonate, a long alkyl chain carboxylic acid, potassium hydroxide, potassium silicate, a non-ionic solid organic water soluble material such as a sucrose or urea, and a hydroxylic solvent.

Despite the number of foaming compositions known, the continual threat of fire to property, structures, goods and the bush and the destruction, devastation and loss of life it causes means that there is an ongoing need for new, improved or at least alternative aqueous foaming compositions, foam compositions, and methods of preparing foaming compositions. There also is a particular need for preparing foam compositions that are substantially or totally biodegradable and/or environmentally compatible.

SUMMARY OF THE INVENTION

Is has surprisingly been found by the present inventors that the use of a carbonised saccharide composition in fire-fighting foams greatly enhances the performance of the foam. The advantageous use of a carbonised saccharide composition provides improved foaming compositions which also exhibit good biodegradability and environmental compatibility.

Thus according to a first aspect of the present invention there is provided a foam forming composition comprising:

a carbonised saccharide composition, a surfactant, and water.

According to a second aspect of the present invention there is provided a foam composition prepared from the foam forming composition of the first aspect.

According to a third aspect of the present invention there is provided a process for preparing a foam composition including the step of aerating a foam forming composition comprising a carbonised saccharide composition, a surfactant, and water. The foam forming composition is preferably aerated by adding the foam forming composition to a flow of water, preferably water flowing through a hose and nozzle such as a fire-fighting hose.

According to a fourth aspect of the present invention there is provided a process for preparing a foam forming composition including mixing a carbonised saccharide composition, a surfactant and water in any suitable order to form the composition.

According to a fifth aspect of the present invention there is provided a method for enhancing the fire fighting capabilities of a foam including the step of preparing a foam forming composition containing a carbonised saccharide composition for use in the preparation of the foam.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

DETAILED DESCRIPTION OF ILLUSTRATIVE EMBODIMENTS

The invention provides chemical compositions that can be aerated to form an expanded foam composition (also referred to as a "foam"). The foam can be used in various applications including any applications understood to be useful in the art of aqueous foam materials. The foam finds particular utility in fighting Class A fires including structural fires, packaging fires, material fires, tyre fires, coal fires, peat fires, wild fires, bush fires, forest fires and other similarly naturally occurring and industrially based fires.

The foam can also be useful to contain or suppress volatile, noxious, explosive, flammable, or otherwise dangerous chemical vapors. The vapors may evolve from a chemical such as a chemical storage tank, a liquid or solid chemical, or a chemical spill. The foam can also be used to extinguish a chemical fire or to prevent ignition or re-ignition of a chemical. These applications will be referred to collectively for purposed of the present description as "application to a chemical" or application to a "liquid chemical". The compositions are especially useful for extinguishing and securing extremely flammable (e.g., having low boiling point and high vapor pressure) and difficult-to-secure chemicals, for example transportation fuels such as methyl t-butyl ether (MTBE) and ether/gasoline blends. Additionally, the foam can be applied to other substrates that are not necessarily hazardous, volatile, ignited, or ignitable. As an example, the foam may be applied to land, buildings, or other physical or real property in the potential path of a fire, as a fire break, e.g., to prevent or at least delay such property from catching fire.

As used herein, the term "foam" is used according to its industry-accepted sense, to mean a foam made by physically mixing a gaseous phase (e.g., air) into an aqueous liquid to form a two phase system of a discontinuous gas phase and a continuous aqueous phase.

The fire fighting foam of the invention exhibits enhanced fire performance due to the addition of a carbonised saccharide composition comprising a mixture of one or more simple sugars and prepared carbonised sugars.

Saccharides for use in the present invention are generally simple sugars or other such carbohydrates, preferably common sugar (sucrose) derived from sugar cane or sugar beets. Sucrose is a disaccharide composed from the basic, simple sugar molecules glucose and fructose. Sucrose is readily available given that the world production from cane and sugar beet is in the order of millions of tonnes per annum. Those skilled in the art will also be aware that other commercially available simple saccharides and sugars can be utilised in the foaming compositions of the invention.

The carbonised saccharides include caramelised, charred or burnt sugars such as treacle, golden syrup and molasses. In this regard reference to the term "carbonised" as it refers to sugars and saccharides is taken in its broadest sense to include caramelised sugars including those that are sublimed, partially sublimed, flaked, baked, heat-treated or chemically treated to effect a morphological and/or chemical change to the sugar normally resulting in a form of polymerisation of the sugar molecules with concomitant darkening or charring of the sugar.

The carbonised saccharide composition typically contains partially refined saccharide components of, for example, cane sugar present as brown or dark brown sugar, which enhances performance and consistency of performance over mixtures without caramelised, charred or burnt components.

Controlled heating of a raw extract of saccharides a little above its melting point caramelises (or carbonises) the sugar molecules with a loss of water to form yellow, brown or dark brown-coloured sugar products such as molasses. As known in the art, caramelisation of sugars can be achieved by the action of steam pressure on sugar in a caramelising kettle, at a set temperature and for a controlled duration. Usually a heating interval of 60-180 minutes at a temperature of approximately 160-180° C. will give satisfactory results. Typically gentler heating will produce a yellow or brown caramelised sugar, whereas stronger and/or prolonged heating will form darker brown or even black sugars more generally referred to as carbonised sugars.

As used herein, the term "caramelised sugar" is taken to mean any darkened process sugar which includes the lighter caramelised sugars. The addition of carbonised sugar to common white sugar, with the optional addition of invert sugar, produces processed sugar commonly known as brown sugar. In a preferred embodiment, the carbonised saccharide composition for use in the foam forming compositions of the present invention is a brown sugar which has been subjected to a heating or drying step in the manufacturing process.

Alternatively brown sugar is prepared by heating purified sugar syrup until it crystallises to form a soft yellow or brown sugar. The amount and duration of heating has a direct effect on the strength and darkness of the resultant brown sugar.

Dark brown sugar, as supplied by CSR Australia, is particularly suitable for use in the compositions and methods of this invention. The CSR brown sugar comprises sucrose crystals painted with molasses syrup. The proportions are about >85% cane sugar (sucrose and reduced sugars such as glucose/fructose), <15% molasses, and <10% ash (carbonised sugars) and moisture, plus other organics including dextrin and other sugar cane related materials. In the production of the brown sugar, the carbonised saccharide mixture is subjected to a heating or drying step. It is thought that this processing step improves the fire resistance properties of the aqueous foaming compositions of the invention.

Carbonisation of sugars is also possible by treating the sugar with a mineral acid such as sulphuric acid which chars the sugar, formic acid, carbon dioxide and sulphur dioxide being evolved, and a blackened mass of carbon resulting.

A particularly preferred carbonised sugar blend is standard brown sugar obtained from CSR Australia. Best results are obtained from carbonised sugar compositions comprising 86-99.7 wt. % sucrose, 0-7 wt. % reduced sugars (eg., fructose and glucose), with molasses and charred/burnt sugars and ash 0.01-10 wt. % as balance. The quantity of water may be in the range of 5-89.9 wt. %, more preferably 45-70 wt. %; the surfactant 3-33 wt. % and the thickener 0-10 wt. %.

Surfactants are included in the foaming compositions to facilitate foam formation upon aeration, to promote spreading of drainage from the foam composition as a vapor-sealing aqueous foam over a liquid chemical, and, where desired, to provide compatibility of the surfactant with sea water. Useful surfactants include water-soluble hydrocarbon surfactants and silicone surfactants, and may be non-ionic, anionic, cationic or amphoteric. Particularly useful surfactants include hydrocarbon surfactants which are anionic, amphoteric or cationic, e.g., anionic surfactants preferably having a carbon chain length containing from about 6 to about 12 or up to 20 carbon atoms. Saccharide surfactants, such as the non-ionic alkyl polyglycosides, can also be useful to the composition.

Organic solvents can be included in the foaming composition to promote solubility of a surfactant, to improve shelf life of a concentrated adaptation of the foaming composition, to stabilise the foam, and in some cases to provide freeze protection. Organic solvents useful in the foaming composition include but are not limited to glycols and glycol ethers including diethylene glycol n-butyl ether, dipropylene glycol n-propyl ether, hexylene glycol, ethylene glycol, dipropylene glycol monobutyl ether, dipropylene glycol monomethyl ether, dipropylene glycol monopropyl ether, propylene glycol, glycerol, polyethylene glycol (PEG) and sorbitol.

Thickening agents are well known in the chemical and polymer arts, and include, inter alia, polyacrylamides, cellulosic resins and functionalised cellulosic resins, polyacrylic acids, polyethylene oxides and the like. One class of thickener that can be preferred for use in the foaming composition and methods of the invention is the class of water-soluble, polyhydroxy polymers, especially polysaccharides. The class of polysaccharides includes a number of water-soluble, organic polymers that can increase the thickness, viscosity or stability of a foam composition. Preferred polysaccharide thickeners include polysaccharides having at least 100 saccharide units or a number average molecular weight of at least 18,000. Specific examples of such preferred polysaccharides include xanthan gum, scleroglucan, heteropolysaccharide-7, locust bean gum, partially-hydrolyzed starch, guar gum and derivatives thereof. Examples of useful polysaccharides are described, for example, in U.S. Pat. Nos. 4,060,489 and 4,149,599. These thickening agents generally exist in the form of water-soluble solids, e.g., powders. While they are soluble in water, in their powder form they can and typically do contain a small amount of adventitious or innate water, which is absorbed or otherwise associated with the polysaccharide.

The concentrate composition of the present invention also may comprise a polysaccharide, preferably an anionic heteropolysaccharide having a high molecular weight. Commercially available polysaccharides useful in the invention include those sold under the trademarks, e.g., Kelzan™ and Keltrol™ (available from Kelco). The polymeric structure is not critical for the purposes of this invention. Only a small amount of polysaccharide is required to result in a noticeable change in properties.

Optionally, other polymeric stabilisers and thickeners can be incorporated into the concentrate compositions of the invention to enhance the foam stability of the foam produced by aeration of the aqueous solution made from the concentrate. Examples of suitable polymeric stabilisers and thickeners are partially hydrolzyed protein, starches and modified starches, polyacrylic acid and its salts and complexes, polyethyleneimine and its salts and complexes, polyvinyl resins, e.g., polyvinyl alcohol, polyacrylamides, carboxyvinyl polymers and poly(oxyethylene)glycol.

Other ingredients known to those skilled in the art that are usually employed in fire-fighting compositions may be employed in the concentrate compositions of this invention. Examples of such ingredients are preservatives, buffers to regulate pH (e.g., tris(2-hydroxyethyl)amine or sodium acetate), corrosion inhibitors (e.g., toluoltriazole or sodium nitrite), antimicrobial agents, divalent ion salts, foam stabilisers and humectants. In addition, flame retardant materials such as inorganic salts (ex phosphates or sulfates) and organic salts (such as salts of acetate).

A foaming composition can be prepared by mixing or combining together its ingredients, e.g., water, a carbonised saccharide mixture, and surfactant, plus any additionally desired ingredients. For example, a foaming composition can be prepared by providing water, e.g., a fixed amount within a reaction vessel or other container, or preferably a flow of water travelling through a hose or pipe, most preferably a hose, and then adding non-water ingredients (e.g., surfactant, thickener, etc.) to the water. The non-water ingredients can be added to the water individually or as one or more mixtures, and in any desired order.

A foaming composition can be prepared using foam production equipment known in the fire-fighting art. Such equipment can include a conventional hose to carry a flow of water, plus appurtenant equipment useful to inject, educt or otherwise add non-water ingredients to the flow of water. Water can flow under pressure through a fire hose, and surfactant, thickener, and other non-water ingredients can be injected or drawn (e.g., educed by venturi effect) into the flow of water. Other techniques such as compressed gas foaming systems can be employed as well known to those skilled in the art.

The composition of the invention is employed in the usual way to combat fires of flammable liquids or to prevent evaporation of flammable vapours. The composition is particularly suitable for application in the form of a foam. Usually it is stored in the form of an aqueous concentrate only requiring dilution typically as a 1, 3 or 6% concentrate with either fresh, brackish or sea water to form the "premix", followed by aeration of the premix to produce a foam which is applied to the burning substrate or substrate to be protected as required. The use of carbonised saccharide mixtures provides better fire protective properties of the foams of the invention when sea water, or brackish water, is used as the diluent.

The foam mixture of the invention is a capable Class A foam that due to the surfactant mixture is capable of wetting fuels such as wood, paper, rubber, fabric, etc., and provide higher retained moisture to prevent combustion. Without wishing to be limited to theory, it is believed that the inclusion of sugars, and charred or burnt sugars, and related molasses and partially refined components of sugar cane, will form a protective layer and char further when fire impinges on the coated material. In a fire situation, the foam mixture can extinguish the fire via cooling and smothering (oxygen removal). The related sugar compounds could again form a protective layer on the combustible fuel if applied at significant concentrations.

The foam of the invention has rapid flow characteristics on flammable liquids, like an aqueous film forming foam (AFFF), yet does not necessarily fulfil the mathematical parameters of the spreading coefficient calculation, nor does it necessarily have a positive spreading coefficient. However the mixtures do have measurable and well-defined surface tensions and interfacial tensions.

Other uses, embodiments and advantages of this invention are further illustrated by the following examples, but the particular materials and amounts thereof cited in these examples, as well as other conditions and details, should not be construed to unduly limit this invention.

EXAMPLES

The foam mixture of the invention exhibits fire control, fire extinguishment, and burn back resistance capabilities similar to AFFF technology when used on flammable liquids. This has been observed on a number of flammable liquid fuels and a variety of flammable liquid test pools (of surface area 0.28 $m^2$, 3.0 $m^2$, 4.5 $M^2$, and 90 $m^2$). Tests were conducted on flammable liquids such as AVGAS, AVTUR, and naphthalated blends. The first three test surface areas relate to standard fixed application tests as follows: Def (Aust) 5603C (0.28 $m^2$); ICAO Level A (3.0 $m^2$); and ICAO Level B (4.5 $m^2$). The 90 $m^2$ surface area test does not represent a standard test, but represents an application density of between 2.5-5.0 ltm/$m^2$ on larger fires as per the recommendations of Underwriters Laboratories.

Example 1

A typical formulation consists of the following general mixture suitable for use at 6 wt. % concentration (with 94% water). The ingredients are mixed in order. This mixture is suitable for dilution and foamed expansion for application to flammable liquid fires. Persons skilled in the art may alter the proportions as appropriate to make concentrations other than 6 wt. %, such as for example 3 wt. % and 1 wt. % as desired.

| Raw Material | Mixing Time | % By Weight of Raw Material |
|---|---|---|
| Water | Start (heat to 65 C.) | 60-80% |
| Diethylene Glycol Monobutyl Ether (Butyl Di-Incinol) | Use to disperse Keltrol and starch | 7-14% |
| Xanthan Gum (Keltrol) | Mix for 1 hour | 0-4% |
| Starch (Cerestar) | Mix for 16 hours | 0-4% |
| Carbonised Sugar Blend | Mix approx. 1 hr | 3-20% |
| Diethanolamine Lauryl Sulfate | Mix 20 mins | 0-5% |
| Sodium Decyl Ethoxy Sulfate | Mix 20 min | 0-5% |
| Cocamidopropyl Betaine | Mix 20 min | 0-5% |
| Cocamidopropyl Hydroxy Sultaine | Mix 20 min | 0-5% |
| Sodium Octyl Sulfate | Mix 20 min | 0-5% |
| Sodium Decyl Sulfate | Mix 20 min | 0-5% |
| Alkyl polyglycocide (C8-C16 distributions) | Mix 20 min | 0-5% |

Example 2

A typical formulation consisting of the following components is provided for use at 6 wt. % concentration (with 94% water). The concentrate is diluted with water then expanded as a foam for application to flammable liquid fires.

| Raw Material | Mass (kg) | Weight % |
|---|---|---|
| Tap Water | Approx 4226.95 | Approx 65.00 |
| Diethylene glycol monobutyl ether | 498.55 | 7.67 |
| Xanthan gum | 47.45 | 0.73 |
| Starch | 44.85 | 0.69 |
| Diethanolamine lauryl sulfate | 348.4 | 5.36 |
| Sodium decyl ethoxy sulfate | 191.75 | 2.95 |
| Cocamido propyl betaine | 130.00 | 2.00 |
| Cocamido propyl hydroxysultaine | 166.40 | 2.56 |
| Carbonised sugar mixture | 417.95 | 6.43 |
| Alkylpolyglycoside | 139.10 | 2.14 |
| Dextrose | 278.85 | 4.29 |
| Triethanolamine | 6.50 | 0.10 |
| Biocide | 6.50 | 0.10 |
| Benzotriazole | 3.25 | 0.05 |
| TOTAL | 6500 | 100 |

The raw materials are mixed together in the order set out above. The raw materials may also be mixed together in any suitable order and way as known to those skilled in the art.

The formula mix may be pH adjusted such as to neutral if required.

Example 3

The aqueous foaming composition (concentrate) below was prepared by the general method of Example 1.

| Raw Material | Mass (kg) |
|---|---|
| Water | 3793 |
| Butyl Di-Incinol | 448 |
| Alkyl polyglycoside | 100 |
| A Sugar (variable Y as per Results Table below) | 750 |
| DEA lauryl Sulfate | 250 |
| Cocamidopropyl betaine | 93.5 |
| Cocamidopropyl hydroxy sultaine | 119.5 |
| Na Decyl Ethoxy Sulfate | 137.5 |

The concentrate is a 6% mixture. It was diluted with fresh water (97%) and expanded at a nozzle flow rate of 11.3 mL/sec. Fire testing was carried out on a 0.28 square meter fire test pan to compare the effect of the carbonised sugar blend with other sugars and blends. The results are provided in the table below which compares the various sugars as variable Y present in the concentrate in an amount of about 14%.

| Variable Sugar (Y) | Avtur 75% Control | Avtur Ext. | Avtur 33% Burn Back | Avgas 75% Control | Avgas Ext. | Avgas 33% Burn Back |
|---|---|---|---|---|---|---|
| Carbonised Sugar Blend (CSR) | 23 s | 40 s | 12:54 | 26 s | 60 s | 8:12 |
| Sucrose | 24 s | 81 s | 8:36 | 30 s | 83 s | 6:12 |
| Treacle | 25 s | 111 s | No Result | 29 s | 237 s | No Result |
| Golden Syrup | 27 s | 81 s | 6:24 | 31 s | 160 s | No Result |
| Molasses | 25 s | 67 s | 8:42 | 27 s | 196 s | No Result |
| Raw Sugar | 23 s | 61 s | 9:00 | 32 s | 116 s | No Result |
| Surcose/ Molasses mixture | 26 s | 54 s | 8:54 | 71 s | 183 s | No Result |
| No Sugar | 27 s | 82 s | 9:00 | 24 s | 140 s | No Result |

Note:
#1 Sucrose/Molasses mixture represents the Carbonised Sugar Blend before treatment, that is a simple admixture of molasses and sucrose.
#2 No burn back result is recorded if extinguishment exceeds 90 seconds.

The table of results for Example 3 depicts the effectiveness of various sugar compositions in the control and extinguishment of standard 0.28 $m^2$ test pan fires. Avtur is standard Jet A-1 fuel, a form of kerosene. Avtur is standard high octane petrol aviation fuel. 75% control represents the to time taken to bring the pan fire under control to 75%. Ext. represents the time taken to extinguish the fire. 33% burn back is representative of when 33% of the fire pan is relit with fire. A larger burn back time represents better performance of the foam.

The results highlight the effectiveness in general of the carbonised sugar blend (CSR Australia) over that of straight sucrose, treacle, golden syrup, raw sugar and an admixture of sucrose/molasses, and the absence of any sugar.

Example 4

The following table shows the fire performance of the carbonised saccharide mixture (brown sugar) foam of Example 3 according to the present invention in three different size fire pan tests. The concentrate was diluted with water (94%) and pumped onto the fire at the flow rate indicated.

| Fire Tests (11.3 mL/sec flow) | 75% Control | Extinguish | 33% Burn Back |
|---|---|---|---|
| 0.28 $m^2$ pan | | | |
| Avtur/Fresh Water (11.3 mL/sec) | 23 sec | 40 sec | 12:54 |
| 4.5 $m^2$ pan | | | |
| Avtur/Fresh Water (11.4 1 pm) | 35 sec | 78 sec | — |
| 90 $m^2$ pan | | | |
| Avtur/Fresh Water (225 1 pm) | — | 3:57 | — |

Seven additional repeats of the fire testing for carbonised saccharide mixture (brown sugar) foam of Example 3 using the 0.28 $m^2$ fire pan with AVTUR and fresh water showed fire test variation on the control time of 25 s±5 s; extinguishment at 50 s+15 s; and 33% burn back resistance of 11:00±2:00 minutes.

Example 5

The following table shows the fire performance of the sugar foams of Example 3 and the carbonised sugar mixture of Example 3 according to the invention in a 0.28 $m^2$ fire pan, comparing the differences of diluting the concentrate with either fresh water or sea water.

The concentrate was diluted with water (94%) and pumped onto the fire at the flow rate indicated.

| Fire Test | 75% Control | Extinguish | 33% Burn Back |
|---|---|---|---|
| 0.28 $m^2$ pan | | | |
| Sugar-Sucrose Avtur/Fresh Water | 30 s | 83 s | 6:12 |
| Sugar-Sucrose Avgas/Sea Water | 28 s | 153 s | No Result |
| Sugar-Carbonised Sugar Blend Avtur/Fresh Water | 23 s | 40 s | 12:54 |
| Sugar-Carbonised Sugar Blend Avgas/Sea Water | 26 s | 60 s | 8:12 |

In this comparative Example, the expanded foam absent any carbonised saccharides showed a longer extinguishment time in the 0.28 $m^2$ pan test for Autur/fresh water of 83 seconds, compared with the expanded foams of Example 3 (40 sec). The burn back resistance of the foam containing the carbonised sugar blend is significantly better than the foam containing just sucrose, plus the added advantage of sea water compatibility.

Example 6

The following table shows the fire performance of a foam prepared from the above concentrate from Example 2 (used at 6 wt. % concentration) a using carbonised sugar blend on the ICAO level B fire performance test. The nozzle flow rate is 11.4 lpm on a 4.5 square meter circular pan. The carbonised sugar blend foam of the present invention is compared with prior art AFFF foams.

Table of ICAO Level B Fire Performance (4.5 $m^2$ pan) Test Results

| | ICAO Level B Spec | Carbonised sugar blend composition | 3M ™ LightWater ™ AFFF FC-206CF | 3M ™ LightWater ™ AFFF FC-3003 |
|---|---|---|---|---|
| Solution Strength | 3 or 6% | 6 | 6 | 6 |
| 90% Control | — | 30 s | 38 s | — |
| Extin-guish-ment | <60 s | 46 s | 46 s | 50 s |
| Burn Back Time | >5:00 | >8:00 | >8:00 | 7:06 |

The above table highlights the effectiveness of the carbonised sugar blend foam compositions compared to know fire foam compositions.

Example 7

A typical formulation consisting of the following components is provided for use at 3 wt. % concentration (with 97% water). The concentrate is diluted with water then expanded as a foam for application to flammable liquid fires.

| Raw Material | Mass (kg) | Weight % |
|---|---|---|
| Tap Water | Approx 3165.30 | Approx 70.34 |
| Diethylene glycol monobutyl ether | 245.70 | 5.46 |
| Xanthan gum | 46.20 | 1.02 |
| Starch | 46.20 | 0.97 |
| Diethanolamine lauryl sulfate | 245.7 | 5.46 |
| Sodium decyl ethoxy sulfate | 106.20 | 2.36 |
| Cocamido propyl betaine | 72.00 | 1.60 |
| Cocamido propyl hydroxysultaine | 92.16 | 2.05 |
| Carbonised sugar mixture | 268.56 | 5.97 |
| Alkylpolyglycoside | 77.04 | 1.71 |
| Dextrose | 179.18 | 3.98 |
| Triethanolamine | 4.50 | 0.10 |
| Biocide | 4.50 | 0.10 |
| Benzotriazole | 2.25 | 0.05 |
| TOTAL | 4500 gm | 100 |

The raw materials are mixed together in the order set out above. The raw materials may also be mixed together in any suitable order and way as known to those skilled in the art. The formula mix may be pH adjusted such as to neutral if required.

The 3% foam composition was subjected to the standard 0.28 $m^2$ fire pan test.

| | Avtur 75% Control | Avtur Ext. | Avtur 33% Burn Back | Avgas 75% Control | Avgas Ext. | Avgas 33% Burn Back |
|---|---|---|---|---|---|---|
| 3% concentrate | 22 s | 62 s | 10:12 | 25 s | 55 s | 7:18 |

Note:
Avtur testing done with fresh water foam premix; Avgas testing done with synthetic sea water premix The above results show the utility and advantages of adding carbonised saccharides to foam compositions for active and passive fire fighting. The preferred foaming compositions of the present invention are prepared without fluorochemical compounds or other environmentally persistent compounds, providing aqueous foaming compositions which are substantially or totally biodegradable and/or environmentally compatible.

The foams of the invention are useful for application to grassland, woodland, bush, scrub or forest, or to liquids chemicals, wood, paper, fabric, cardboard or other substrates which are on file or may be volatile, flammable, otherwise hazardous, or not hazardous at all but desirably protected from potential ignition.

The reference to any prior art in this specification is not, and should not be taken as, an acknowledgment or any form of suggestion that that prior art forms part of the common general knowledge in the field of endeavour.

Those skilled in the art will appreciate that the invention described herein is susceptible to variations and modifications other than those specifically described. It is to be understood that the invention includes all such variations and modifications. The invention also includes all of the steps, features, compositions and compounds referred to or indicated in this specification individually or collectively, and any and all combinations of any two or more of said steps or features.

The invention claimed is:

1. An aqueous diluted solution of a foam forming composition comprising:

a dark brown sugar that has been subjected to a carbonisation step during its manufacture, a surfactant, and water.

2. The aqueous diluted solution of claim 1, wherein the dark brown sugar is a mixture of the crystals of one or more simple sugars that have been painted with molasses, and a carbonised sugar.

3. The aqueous diluted solution of claim 2, wherein the simple sugars are selected from the group consisting of sucrose, glucose, fructose, mannose and invert sugar.

4. The aqueous diluted solution of claim 2, wherein the carbonised sugar is prepared from sucrose, glucose, fructose, invert sugar or a mixture thereof.

5. The aqueous diluted solution of claim 4, wherein the sugar is carbonised by the controlled heating of the sugar a little above its melting point for a time sufficient to caramelise the sugar.

6. The aqueous diluted solution of claim 5, wherein the dark brown sugar comprises a mixture of greater than 85 wt. % simple sugars, less than 15 wt. % molasses, and less than 10 wt. % carbonised sugars.

7. The aqueous diluted solution of claim 6, wherein the dark brown sugar comprises a mixture of about 86 to 99.7 wt. % sucrose, about 0 to 7 wt. % glucose/fructose, with a balance of about 0.01 to 10 wt. % molasses and carbonised sugars; and wherein the dark brown sugar is present in an amount of 3 to 20 wt. %.

8. The aqueous diluted solution of claim 7, wherein the water is present in an amount of 5 to 89.9 wt. %.

9. The aqueous diluted solution of claim 7, wherein the surfactant is present in an amount of 3 to 33 wt. %.

10. The aqueous diluted solution of claim 9, wherein the foam forming composition further comprises a thickening agent and optionally one or more components selected from the group consisting of organic solvents, polymeric stabilisers, preservatives, buffers, corrosion inhibitors, antimicrobial agents, divalent ion salts, foam stabilisers, humectants and diluents.

11. The aqueous diluted solution of claim 10, wherein the thickening agent is present in an amount of 0 to 10 wt. %.

12. The aqueous diluted solution of claim 9, wherein the surfactant is a water-soluble hydrocarbon surfactant or silicone surfactant, and wherein the surfactant is non-ionic, anionic, cationic or amphoteric.

13. The aqueous diluted solution of claim 10, wherein the thickening agent is selected from the group consisting of a polyhydroxy polymer, polyacrylamide, cellulosic resin, polyacrylic acid, polyethylene oxide or mixtures thereof.

14. The aqueous diluted solution of claim 10, wherein the organic solvent is selected from the group consisting of glycols and glycol ethers.

15. The aqueous diluted solution of claim 1 wherein it is free of fluorochemical compounds.

16. A process for preparing a foam composition including the step of aerating an aqueous diluted solution of a foam forming composition comprising:

a dark brown sugar that has been subjected to a carbonisation step during its manufacture, a surfactant, and water.

17. The process of claim 16, wherein the foam forming composition is aerated by a compressed gas foaming system.

18. The process of claim 16, wherein the foam forming composition is aerated by adding the foam forming composition to a flow of water and discharging through a nozzle.

19. A method of fighting a fire, comprising the step of applying the foamed composition according to claim 1 to the fire.

20. A method of fighting a flammable liquid or chemical fire, comprising the step of applying the foamed composition according to claim 1 to extinguish the flammable liquid or chemical fire or to prevent ignition or re-ignition of the flammable liquid or chemical fire.

21. A method of containing or suppressing dangerous flammable liquid or chemical vapors, comprising the step of applying the foamed composition according to claim 1 to contain or to suppress the dangerous flammable liquid or chemical vapors.

* * * * *